US009797209B2

(12) United States Patent
Hampson et al.

(10) Patent No.: US 9,797,209 B2
(45) Date of Patent: Oct. 24, 2017

(54) USE OF MULTIPLE STACKED COILED TUBING (CT) INJECTORS FOR RUNNING HYBRID STRINGS OF CT AND JOINTED PIPE OR MULTIPLE CT STRING

(71) Applicants: Halliburton Energy Services, Inc., Houston, TX (US); Kirstin Corney, Longside (GB)

(72) Inventors: Richard J. Hampson, Stonehaven (GB); John William Foubister, Westhill (GB); Ian David Corney, Longside (GB)

(73) Assignee: Halliburton Energy Services, Inc., Houston, TX (US)

( * ) Notice: Subject to any disclaimer, the term of this patent is extended or adjusted under 35 U.S.C. 154(b) by 503 days.

(21) Appl. No.: 14/088,959

(22) Filed: Nov. 25, 2013

(65) Prior Publication Data

US 2015/0144357 A1 May 28, 2015

(51) Int. Cl.
*E21B 19/22* (2006.01)
*E21B 17/20* (2006.01)

(52) U.S. Cl.
CPC ..... *E21B 19/22* (2013.01); *E21B 17/20* (2013.01)

(58) Field of Classification Search
None
See application file for complete search history.

(56) References Cited

U.S. PATENT DOCUMENTS

| | | | | |
|---|---|---|---|---|
| 4,899,823 | A | 2/1990 | Cobb et al. | |
| 5,244,046 | A | 9/1993 | Council et al. | |
| 5,738,173 | A | 4/1998 | Burge et al. | |
| 6,158,516 | A | 12/2000 | Smith et al. | |
| 6,276,454 | B1 | 8/2001 | Fontana et al. | |
| 7,188,683 | B2 * | 3/2007 | Ayling | E21B 19/16 175/122 |
| 8,169,337 | B2 | 5/2012 | Evans et al. | |
| 2009/0272520 | A1 | 11/2009 | Hug et al. | |

OTHER PUBLICATIONS

International Search Report and Written Opinion issued in related PCT Application No. PCT/US2014/067027 dated Feb. 27, 2015, 11 pages.
Office Action issued in related Singapore Application No. 11201602656R, dated Oct. 17, 2016 (9 pages).
International Preliminary Report on Patentability issued in related application PCT/US2014/067027, dated Jun. 9, 2016. 11 pages.

* cited by examiner

*Primary Examiner* — Caroline N Butcher
(74) *Attorney, Agent, or Firm* — Alan Bryson; Baker Botts L.L.P.

(57) ABSTRACT

Methods and apparatus are disclosed concerning an injector apparatus, comprising: an upper injector coupled to a frame, wherein the upper injector has an upper injector passage; a lower injector coupled the frame, wherein the lower injector has a lower injector passage; wherein the upper injector and the lower injector are substantially axially aligned; and a work window between the upper injector and the lower injector.

18 Claims, 5 Drawing Sheets

USE OF MULTIPLE STACKED COILED TUBING (CT) INJECTORS FOR RUNNING HYBRID STRINGS OF CT AND JOINTED PIPE OR MULTIPLE CT STRING

BACKGROUND

The present disclosure relates generally to operations performed and equipment utilized in conjunction with wellbore operations and, in particular, to moving tubular members in and out of a well.

Coiled tubing, jointed pipe, or other similar tubular members generally include cylindrical tubing made of metal or composite. The tubular members may be introduced into an oil or gas wellbore or pipeline through wellhead control equipment to perform various tasks during the exploration, drilling, production, and workover of the well/pipeline. For example, coiled tubing may be inserted by a coiled tubing injector apparatus. Such injectors generally incorporate a pair of opposed endless drive chains which are arranged in a common plane. The drive chains are often referred to as gripper chains because each chain has multiple gripper blocks attached along the chain for handling the tubing as it passes through the injector.

The opposed gripper chains are generally provided with a predetermined amount of slack which allows the gripper chains to be biased against the tubing as the tubing moves into and out of the wellbore. This biasing is accomplished with an endless roller chain disposed inside each gripper chain. Typically, each roller chain engages sprockets rotatably mounted on a respective linear beam. The linear beams may be moved toward one another so that each roller chain is moved against its corresponding gripper chain such that the tubing facing portion of the gripper chain is moved toward the tubing so that the gripper blocks can engage the tubing and move it through the apparatus. When the gripper chains are in motion, the gripper blocks will engage the tubing along a working length of the linear beam. Each gripper chain has a gripper block that comes into contact with the tubing at the top of the working length of the linear beam as another gripper block on the same gripper chain breaks contact with the tubing at the bottom of the working length of the linear beam. This continues as the gripper chains force the tubing into or out of the wellbore.

Tubular members introduced into the wellbore may not have a constant cross section. For example, a variety of outside diameters of tubing may be used in a particular drilling operation, or a pipe joint or connector between two reels of coiled tubing may result in a change in outside diameter of the tubular member directed into the wellbore through the injector.

FIGURES

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to operations performed and equipment utilized in conjunction with wellbore operations and, in particular, to moving tubular members in and out of a well.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples" as used herein are intended to mean either an indirect or direct connection. Thus, if a first device couples to a second device, that connection may be through a direct connection, or through an indirect mechanical or electrical connection via other devices and connections. The term "uphole" as used herein means along the drillstring or the hole from the distal end towards the surface, and "downhole" as used herein means along the drillstring or the hole from the surface towards the distal end.

To facilitate a better understanding of the present invention, the following examples of certain embodiments are given. In no way should the following examples be read to limit, or define, the scope of the disclosure or claims. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may further be applicable to borehole construction for river crossing tunneling and other such tunneling boreholes for near surface construction purposes or borehole u-tube pipelines used for the transportation of fluids such as hydrocarbons. Devices and methods in accordance with embodiments described herein may be used in one or more of measurement-while-drilling and logging-while-drilling operations.

Figure 1:
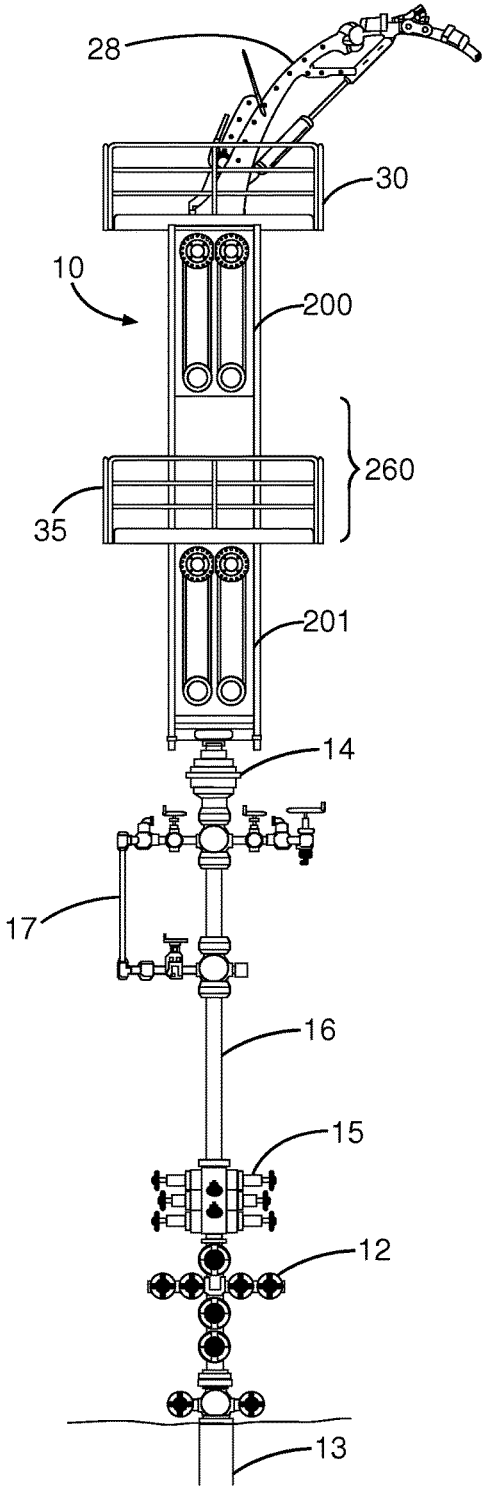
FIG. 1 shows an example system including an injector apparatus in position for inserting a tubular member into an adjacent wellhead, according to aspects of the present disclosure.

Referring to FIG. 1, an example system including an injector apparatus 10 is shown in accordance with the present disclosure. The injector apparatus 10 may be positioned above a wellhead 12 of a wellbore 13. In certain embodiments, a coiled tubing blowout preventer 15 (coiled tubing BOP) may be positioned above the wellhead. The coiled tubing BOP 15 may be a regular, quad, or combi type BOP and may be sized according to the bottom hole assembly as known by one of ordinary skill in the art. For example, a 5⅛" coiled tubing BOP may be used.

In certain embodiments, a lubricator 16 may be positioned above the wellhead 12 and below the injector apparatus 10. In certain embodiments, a stripping ram and equalizing assembly 17 may be placed above the wellhead 12 and below the injector apparatus 10. The stripping ram and equalizing assembly 17 may be connected to the upper end of the lubricator 16. In certain embodiments, the stripping ram and equalizing assembly 17 may include two stripping rams. The distance between the stripping rams may be at least as long as the length of a tool joint or safety valve used in the operation. In certain embodiments, an annular blowout preventer 14 may be placed above the wellhead 12 and below the injector apparatus 10. The annular blowout preventer 14 may be connected to the bottom end of the injector apparatus 10.

The injector apparatus 10 may be used to run pipe or tubing into and/or out of the wellbore 13. The tubing may be coiled tubing, jointed pipe, or combinations thereof.

The injector apparatus 10 may be mounted above the wellhead 12. A guide framework 28 may extend from the top of the injector apparatus 10. The guide framework 28 may be a tubing guide arch. The guide framework 28 may guide coiled tubing into the top of the injector apparatus 10. In certain embodiments, the guide framework 28 may be mounted on sliders to allow the guide framework 28 to move away from the top of the injector apparatus 10 when bottom hole assembly components or jointed pipe are lowered through the injector apparatus 10.

An upper work platform 30 may be mounted atop the injector apparatus 10 to support workers and ancillary equipment.

Figure 2A:
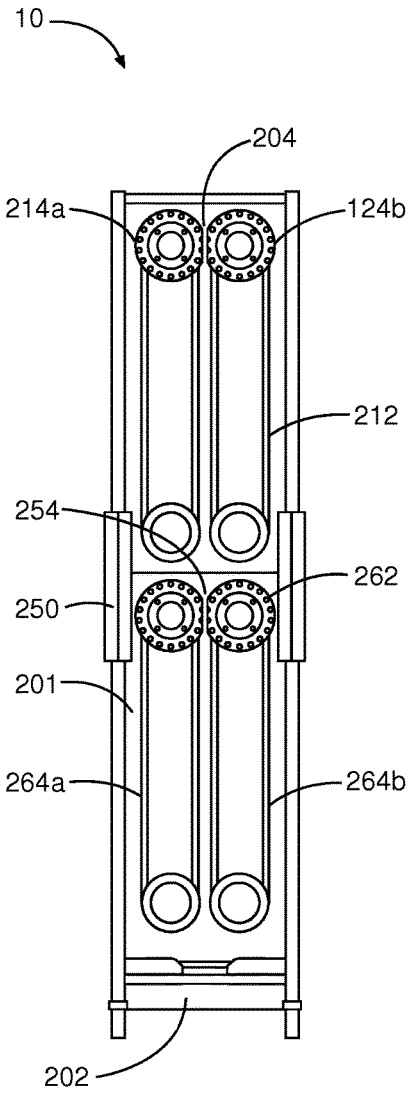
FIG. 2A shows a cross-sectional view of the injector unit in a retracted position, according to aspects of the present disclosure.

Referring now to FIG. 2A, a cross-sectional view of the injector apparatus 10 is shown in the retracted position. The injector apparatus 10 may include an upper injector 200 and a lower injector 201. The upper injector 200 and the lower injector 201 may be any injector suitable for running tubing, pipe, or other tubular members into and/or out of a wellbore, as would be appreciated by one of ordinary skill in the art. For example, the upper injector 200 and/or the lower injector 201 may be a V95K HP Coiled Tubing Injector, produced by Halliburton, Houston, Tex. The upper injector 200 and the lower injector 201 may be mounted to a support structure 202 to join the upper injector 200 and the lower injector 201. The support structure 202 may substantially axially align the upper injector 200 and lower injector 201 so the bottom end of the upper injector 200 is substantially aligned with the top end of the lower injector 201. In certain embodiments, the upper injector 200 and the lower injector 201 may be substantially duplicate injectors.

Figure 2B:
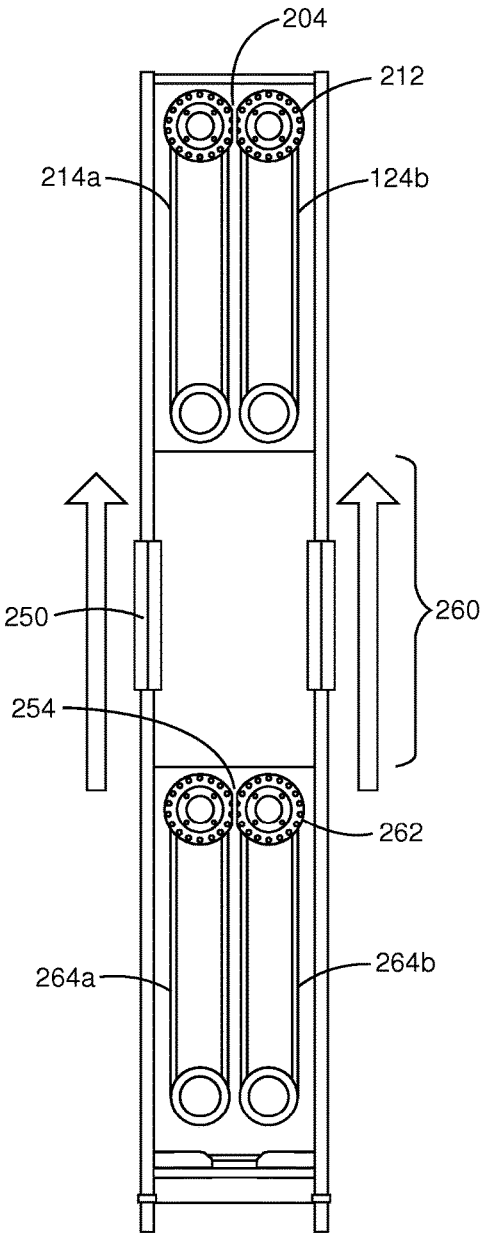
FIG. 2B shows a cross-sectional view of the injector unit in an extended position, according to aspects of the present disclosure.

The support structure 202 may include an extension mechanism 250. The extension mechanism 250 may be operative to move axially from a retracted position (shown in FIG. 2A) to an extended position (shown in FIG. 2B) and from an extended position to a retracted position. The injector apparatus 10 may be moved to the retracted position, for example, to store or transport the injector apparatus 10. In certain embodiments, the extension mechanism 250 may comprise hydraulic rams. As shown in FIG. 2B, the work window 260 may be created between the upper injector 200 and the lower injector 201 when the injector apparatus 10 is placed in the extended position. The work window 260 may extend a suitable distance to allow workers to operate between the upper injector 200 and lower injector 201 as described herein. In certain embodiments, the work window 260 may be about 7 feet to 10 feet in length.

The upper injector 200 may comprise a passage 204 for passing tubular members and a driving mechanism 212. In certain embodiments, the driving mechanism 212 may allow a tubular member to be run into the well or out of the well, as would be appreciated by one of ordinary skill in the art. The driving mechanism 212 may comprise a pair of opposed drive chains 214*a*, 214*b*, and a gripping mechanism (not shown). The driving mechanism 212 may be in an engaged or released position. In the released position, the driving mechanism 212 may allow a tubular member or other tooling member to pass through the upper injector 200 without resistance. In certain embodiments, the driving mechanism 212 in the released position may allow pipe tool joints and/or bottom hole assemblies to pass through without resistance. In the engaged position, the driving mechanism 212 may apply a gripping force to the tubular member located in the passage 204. As such, the driving mechanism 212 may hold the tubular member in place. The driving mechanism 212 may also apply downward and/or upward force to the tubular member to drive the tubular member into or out of the wellbore 13, respectfully. The upper injector 200 may pass the tubular member into the work window 260 toward the lower injector 201.

In certain embodiments, the lower injector 201 may be of a form substantially similar to the upper injector 200. The lower injector 201 may comprise a passage 254 for passing tubular members and a driving mechanism 262. In certain embodiments, the driving mechanism 262 may move a tubular member into the well or out of the well, as would be appreciated by one of ordinary skill in the art with the benefit of this disclosure. The driving mechanism 262 may comprise a pair of opposed drive chains 264*a*, 264*b*, and a gripping mechanism (not shown). The driving mechanism 262 may be in an engaged or released position. In the released position, the driving mechanism 262 may allow a tubular member or other tooling member to pass through the lower injector 201 without resistance. In certain embodiments, the driving mechanism 262 in the released position may allow pipe tool joints to pass through without interference. In the engaged position, the driving mechanism 262 may apply a compressive force to the tubular member located in the passage 254. As such, the driving mechanism 262 may hold the tubular member in place or drive the tubular member into or out of the wellbore 13.

When the injector apparatus 10 is used to inject coiled tubing into the wellbore 13, either the upper injector 200 or the lower injector 201 may be used to engage the coiled tubing. In certain embodiments, both the upper injector 200 and the lower injector 201 may simultaneously engage the coiled tubing to drive it into or out of the wellbore, as needed. Engaging the coiled tubing with multiple injectors may allow greater force to be applied to the coiled tubing.

Figure 4A:
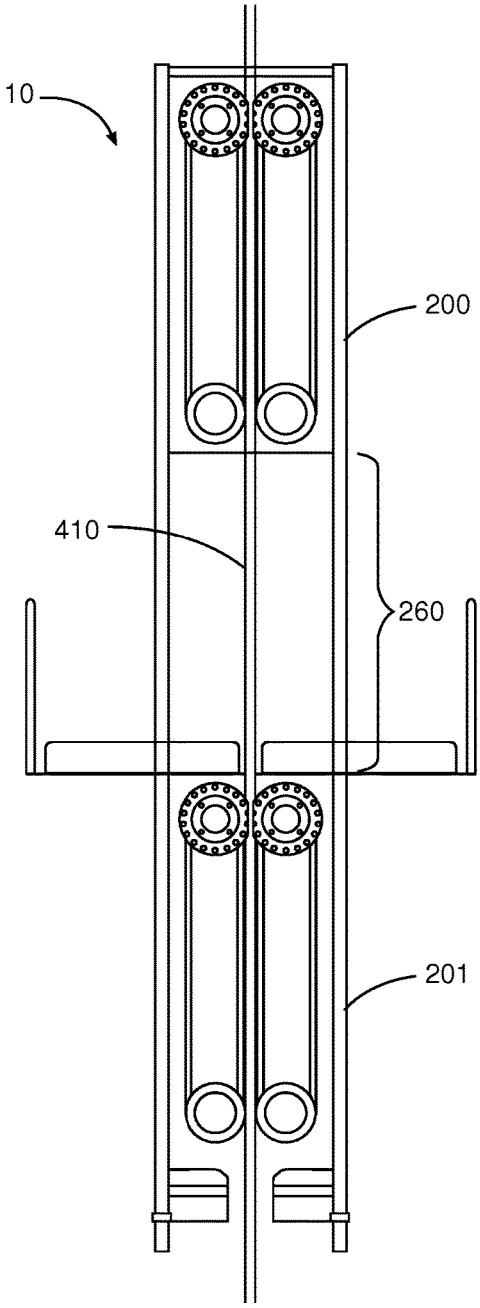
FIG. 4A shows a cross-sectional view of the injector apparatus while running coiled tubing, according to aspects of the present disclosure.

Referring again to FIG. 1, a lower work platform 35 may be mounted in the work window 260 to support workers and ancillary equipment. Referring now to FIG. 4A-4D, an example method of joining a jointed pipe to the end of the coiled tubing is shown according to aspects of the present disclosure. Although the figures show the example of running a coiled tubing first then connecting a jointed pipe, the injection apparatus may be used to run hybrid strings of coiled tubing and jointed pipe in any order. In addition, the injection apparatus may be used to run strings of only coiled tubing or only jointed pipe, as needed by the operation. Referring to FIG. 4A, the injector apparatus 10 is shown running coiled tubing 410 into or out of the wellbore 13. As described above, the upper injector 200, the lower injector 201, or both upper and lower injectors 200, 201 may be used to drive the coiled tubing into or out of the wellbore 13. Both upper and lower injectors 200, 201 may be used, for example, if a heavy pull is required during the operation. While running coiled tubing, no workers may be required in the lower work platform 35.

Figure 4B:
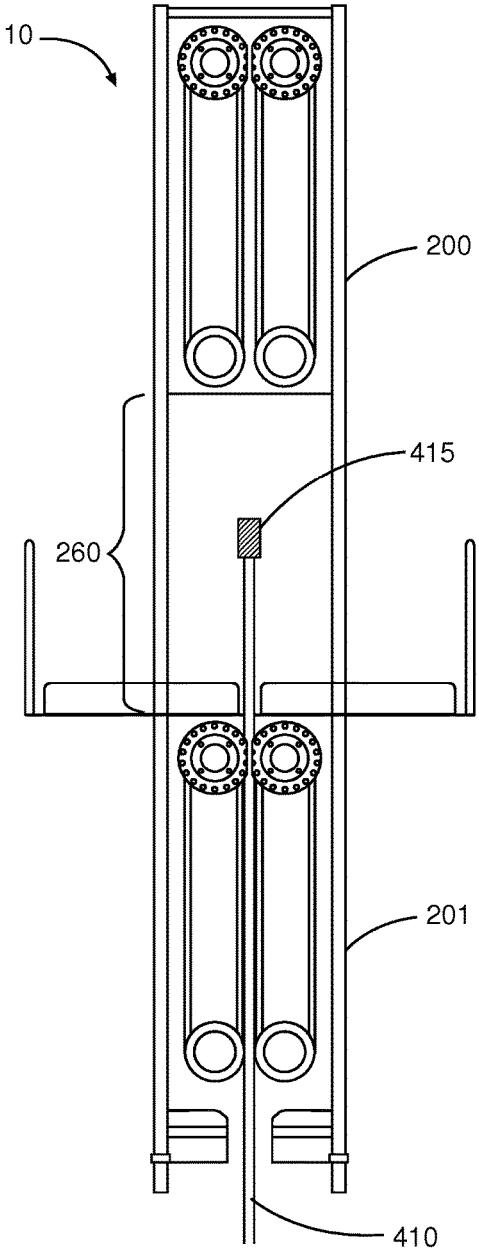
FIG. 4B shows a cross-sectional view of the injector apparatus with a first pipe connection point in the work window, according to aspects of the present disclosure.
Figure 4C:
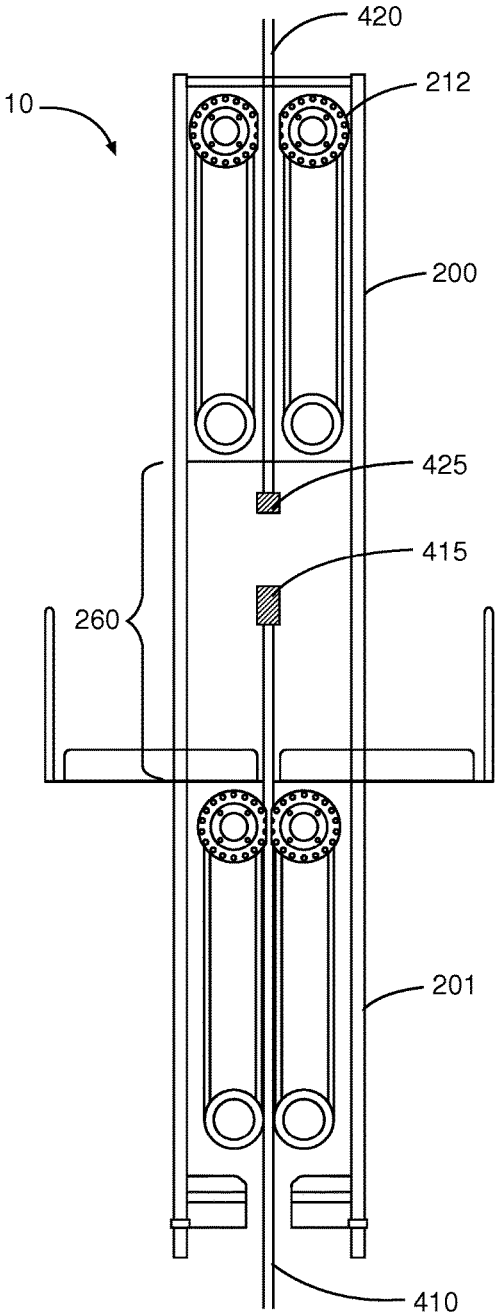
FIG. 4C shows a cross-sectional view of the injector apparatus with a second pipe connected to the first pipe connection point while the lower injector engages the pipe and the upper injector is disengaged, according to aspects of the present disclosure.
Figure 4D:
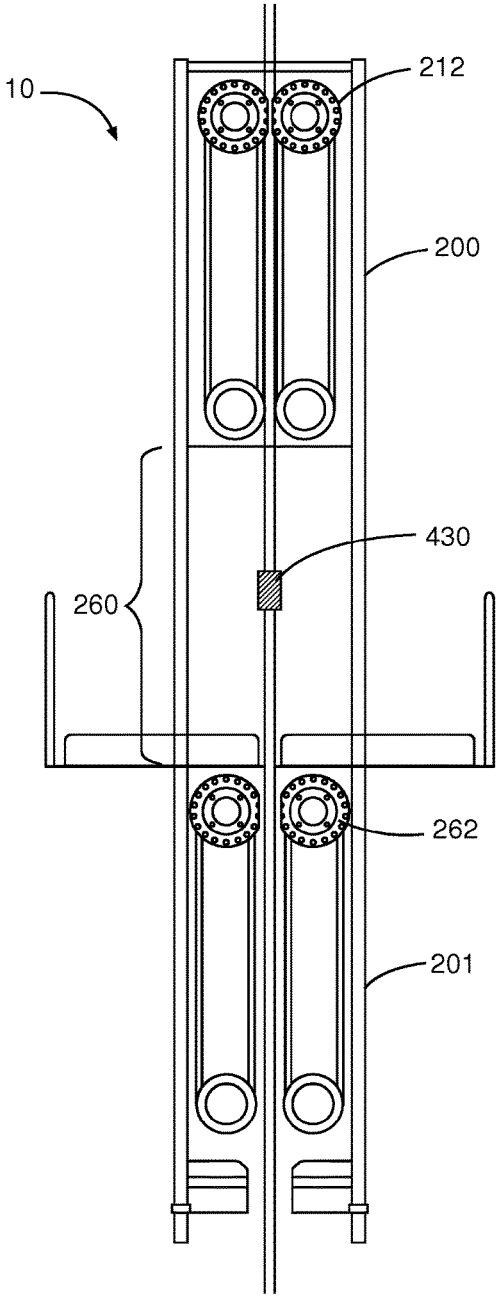
FIG. 4D shows a cross-sectional view of the injector apparatus with the upper injector engaging the pipe and the lower injector disengaged, according to aspects of the present disclosure.

FIG. 4B shows an example implementation wherein a pipe connection point 415 is reached. The pipe connection point 415 may be passed through the upper injector 200 and held in the work window 260 by the lower injector 201. While in the work window 260, the pipe connection point 415 may be accessible by one or more workers to join the pipe connection point 415 with a subsequent tubular member or tool. For example, the coiled tubing 410 may be joined with a subsequent thread of coiled tubing, jointed pipe, or a bottom hole assembly. FIG. 4C shows an example implementation wherein the coiled tubing 410 is joined at the pipe connection point 415 with a jointed pipe 420 having a jointed pipe joint 425. The driving mechanism 212 of the upper injector 200 may be set to the released position, as shown in FIG. 4C, to allow the jointed pipe 420 and jointed pipe joint 425 through the upper injector 200. The lower injector 201 may remain in the engaged position to hold the coiled tubing 410 in place during the joining process. As shown by example in FIG. 4D, once the jointed pipe 420 is connected to the coiled pipe 410 to create a coupling point 430, the upper injector 200 may engage the jointed pipe 420. Once the upper injector 200 has engaged the jointed pipe 420, the lower injector 201 may disengage the coiled pipe 410 and move to the released position to allow the coupling point 430 to pass through the lower injector 201.

After the coupling point 430 passes through the lower injector 201, the lower injector 201 may optionally engage the jointed pipe 420, as desired. This process of alternately engaging and releasing the respective injectors may be repeated to pass each pipe connection point 415, jointed pipe joint 425, and/or coupling point 430 through the injector apparatus 10 as needed.

In certain embodiments, a tong (not shown) may be placed between the upper injector 200 and the lower injector 201 to allow coiled tubing or jointed pipe to be passed through the tong. The tong may guide pipe buckling during snubbing from the upper injector 200. In certain embodiments, the tong may be a Mini Tong from Hunting Energy Services, Inc., Houston, Tex.

Figure 3:
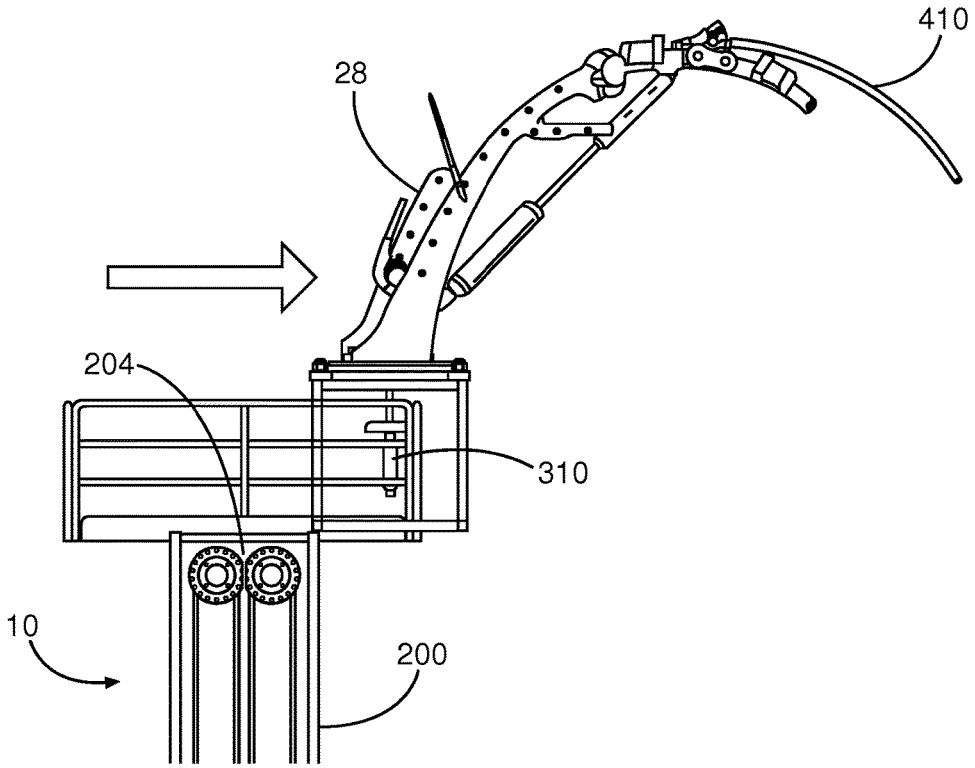
FIG. 3 shows an example retractable guide framework, according to aspects of the present disclosure.

To run jointed pipe or bottom hole assemblies through the injector apparatus 10 and into the wellbore 13, the guide framework 28 may be moved from the central position over the injector apparatus 10 (shown by example in FIG. 1) to an inactive position, as shown by example in FIG. 3. In certain embodiments, the guide framework 28 may be slideably mounted to the upper work platform 30 to allow the guide framework 28 to be moved out of position and allow passage of jointed pipe and/or bottom hole assemblies. In certain embodiments, the guide framework 28 may be completely removed.

With continued reference to FIG. 3, in certain embodiments, the guide framework 28 may allow the coiled tubing to remain stabbed while joint pipe and/or bottom hole assemblies are run through the injector apparatus 10. While the guide framework 28 is in the inactive position, jointed pipe and/or bottom hole assemblies may be lowered through the upper injector 200. In certain embodiments, the guide framework 28 may comprise a coiled tubing clamp 310 to engage the coiled tubing 410. The coiled tubing clamp 310 may attach the coiled tubing 410 to the guide framework 28 to hold the coiled tubing 410 in place when the coiled tubing 410 is not being run into or out of the wellbore 13. To resume running coiled tubing, the guide framework 28 may be moved from the inactive position to the central position and the coiled tubing may be unclamped. The coiled tubing may then be run into the injector apparatus 10.

In certain embodiments, bottom hole assemblies may be passed into or out of the wellbore through the injector apparatus 10. To make up a bottom hole assembly, the upper injector 200 and the lower injector 201 may be open. In certain embodiments, the bottom hole assembly may be passed into the work window 260 through the upper injector 200 using a winch or crane. In certain embodiments, the bottom hole assembly may be brought into the work window 260 through the lower work platform 35. The bottom hole assembly may be held in the work window 260 and/or lower injector 201 using a clamp or similar device. Once the bottom hole assembly is held in place, a tubular member may be brought through the upper injector 200. The tubular member may then be connected to the bottom hole assembly in the work window 260. The upper injector 200 may engage the tubular member so the tubular member to hold the tubular member in place and/or run the bottom hole assembly into the wellbore 13.

In certain embodiments, a method is disclosed, comprising: providing an injector apparatus, comprising: an upper injector coupled to a frame, wherein the upper injector has an upper injector passage; a lower injector coupled the frame, wherein the lower injector has a lower injector passage; wherein the upper injector and the lower injector are substantially axially aligned; and a work window between the upper injector and the lower injector; placing the injector apparatus above a wellbore; and running a first tubular member through the upper injector passage and the lower injector passage and into the wellbore, wherein the first tubular member comprises a downhole end and an uphole end.

In certain embodiments, a method is disclosed, comprising providing an injector apparatus, comprising: an upper injector coupled to a frame, wherein the upper injector has an upper injector passage; a lower injector coupled the frame, wherein the lower injector has a lower injector passage; wherein the upper injector and the lower injector are substantially axially aligned; and a work window between the upper injector and the lower injector; placing the injector apparatus above a wellbore; and running a first tubular member out of the wellbore through the injector apparatus and out of the wellbore, wherein the first tubular member comprises a downhole end and an uphole end.

The present disclosure may be used to run hybrid threads of coiled tubing, jointed pipe, and/or other tubular members using the same injector apparatus without switching between multiple rigs. In addition, no slips may be required as the injector apparatus may act as the slip. As such, the present disclosure may provide many additional advantages over using a slip in connection with running pipes. For example, the injector apparatus may be less damaging to coiled tubing and provide more flexibility for running pipe of various sizes, including tapered outer diameter strings.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. An injector apparatus, comprising:

an upper injector coupled to a frame, wherein the upper injector has an upper injector passage;

a lower injector coupled to the frame, wherein the lower injector has a lower injector passage, and wherein the upper injector passage and the lower injector passage are substantially axially aligned; and a work window between the upper injector and the lower injector, wherein the lower injector is structured and arranged to hold an uphole connection point of a tubular member and pass a downhole tooling member connected to the uphole connection point through the lower injector.

2. The injector apparatus of claim 1, further comprising:

an upper work platform mounted above the upper injector; and a lower work platform mounted above the lower injector in the work window.

3. The injector apparatus of claim 1, wherein the work window is about 7 feet to 10 feet in length.

4. The injector apparatus of claim 1, further comprising.

5. The injector apparatus of claim 4, wherein the guide framework is slideably attached to the upper work platform to allow the guide framework to be moved away from the upper injector passage.

6. A method, comprising:

providing an injector apparatus, comprising:

an upper injector coupled to a frame, wherein the upper injector has an upper injector passage;

a lower injector coupled to the frame, wherein the lower injector has a lower injector passage, and the upper injector and the lower injector are substantially axially aligned; and a work window between the upper injector and the lower injector;

placing the injector apparatus above a wellbore; and running a first tubular member through the upper injector passage and the lower injector passage and into the wellbore until an uphole connection point is reached, wherein the uphole connection point is at the uphole end of the first tubular member;

passing the uphole connection point into the work window; and holding the uphole connection point in the work window, connecting a downhole tooling member to the uphole connection point, and passing the downhole tooling member through the lower injector.

7. The method of claim 6, wherein holding the uphole pipe connection point in the work window further comprises engaging the first tubular member with the lower injector.

8. The method of claim 6, further comprising:

lowering a second tubular member through the upper injector passage, wherein the second tubular member comprises a downhole connection point at a downhole end of the second tubular member; and connecting the first tubular member uphole pipe connection point to the second tubular member downhole connection point.

9. The method of claim 6, further comprising:

engaging the second tubular member with the upper injector;

releasing the first tubular member with the lower injector; and passing the first tubular member uphole connection point and the second tubular member downhole connection point through the lower injector.

10. The method of claim 8, further comprising applying downward force to the second tubular member with the upper injector.

11. The method of claim 6, wherein the first tubular member comprises coiled tubing.

12. The method of claim 6, wherein a second tubular member comprises jointed pipe.

13. A method, comprising:

providing an injector apparatus, comprising:

an upper injector coupled to a frame, wherein the upper injector has an upper injector passage;

a lower injector coupled to the frame, wherein the lower injector has a lower injector passage; wherein the upper injector and the lower injector are substantially axially aligned; and a work window between the upper injector and the lower injector;

placing the injector apparatus above a wellbore; and running a first tubular member through the injector apparatus and out of the wellbore until a downhole pipe connection point is reached, wherein the downhole pipe connection point is on the downhole end of the first tubular member;

passing the downhole pipe connection point into the work window; and holding the downhole pipe connection point in the work window, connecting a downhole tooling member to an uphole connection point, and passing the downhole tooling member through the lower injector.

14. The method of claim 13, wherein passing the downhole pipe connection into the work window further comprises:

engaging the first tubular member with the upper injector;

releasing the first tubular member with the lower injector; and applying an upward force to the first tubular member with the upper injector.

15. The method of claim 13, wherein holding the pipe connection point in the work window further comprises engaging a second tubular member with the lower injector, wherein the second tubular member has an uphole connection point, and wherein the second tubular member uphole connection point is connected to the first tubular member downhole connection point.

16. The method of claim 15, further comprising:

releasing the first tubular member with the upper injector;

disconnecting the first tubular member downhole connection point from the second tubular member uphole connection point; and raising the first tubular member through the upper injector.

17. The method of claim 13, wherein the first tubular member comprises jointed pipe.

18. The method of claim 13, wherein the first tubular member comprises coiled tubing.

* * * * *